US009362070B2

(12) United States Patent
Moreau et al.

(10) Patent No.: US 9,362,070 B2
(45) Date of Patent: Jun. 7, 2016

(54) ARC EXTINGUISHING CHAMBER FOR AN ELECTRIC PROTECTION APPARATUS AND ELECTRIC PROTECTION APPARATUS COMPRISING SAME

(71) Applicant: SCHNEIDER ELECTRIC INDUSTRIES SAS, Rueil-Malmaison (FR)

(72) Inventors: Luc Moreau, Grenoble (FR); Loic Rondot, Grenoble (FR)

(73) Assignee: SCHNEIDER ELECTRIC INDUSTRIES SAS, Rueil-Malmaison (FR)

( * ) Notice: Subject to any disclaimer, the term of this patent is extended or adjusted under 35 U.S.C. 154(b) by 0 days.

(21) Appl. No.: 14/259,697

(22) Filed: Apr. 23, 2014

(65) Prior Publication Data

US 2014/0339197 A1 Nov. 20, 2014

(30) Foreign Application Priority Data

May 17, 2013 (FR) ..... 13 54423

(51) Int. Cl.
*H01H 33/08* (2006.01)
*H01H 9/34* (2006.01)

(52) U.S. Cl.
CPC ..... *H01H 33/08* (2013.01); *H01H 9/342* (2013.01); *H01H 9/345* (2013.01)

(58) Field of Classification Search
CPC ..... H01H 9/32; H01H 9/34; H01H 9/342; H01H 3/60; H01H 33/72; H01H 73/18; H01H 73/20; H01H 9/302; H01H 9/362; H01H 2009/348
USPC ..... 218/41, 151, 149, 155; 335/201
See application file for complete search history.

(56) References Cited

U.S. PATENT DOCUMENTS 2,707,218 A 4/1955 Cellerini
3,043,939 A * 7/1962 Gryctko et al. ..... 218/152

(Continued)

FOREIGN PATENT DOCUMENTS

DE 10 2010 053 507 A1 6/2012
EP 1 017 072 A2 7/2000

(Continued)

OTHER PUBLICATIONS

Machine translation of DE102010053507 (orig. doc. published Jun. 6, 2012).*
French Preliminary Search Report issued Jan. 30, 2014, in French Application No. 13 54423 filed May 17, 2013 (with English Translation of Categories of Cited Documents).

*Primary Examiner* — Renee S Luebke
*Assistant Examiner* — William Bolton
(74) *Attorney, Agent, or Firm* — Oblon, McClelland, Maier & Neustadt, L.L.P.

(57) ABSTRACT

The present invention relates to an arc extinguishing chamber of an electric protection apparatus comprising an arc formation chamber containing a stationary contact and a movable contact which, when they separate, form an arc between them, said arc formation chamber communicating with the inlet of a second chamber, called arc extinguishing chamber. This chamber comprises a wall called balancing wall, substantially solid at least on its central part, said wall being located downstream from the arc extinguishing chamber and being formed and arranged with respect to the arc extinguishing chamber in such a way as to slow down the exhaust flow of the breaking gases on the side of the arc extinguishing chamber where the gases go first, and enhancing flow of the exhaust gases on the opposite side, the exhaust gases being stopped by the central part of the wall and escaping via the edges of the wall.

9 Claims, 4 Drawing Sheets

(56) References Cited

U.S. PATENT DOCUMENTS

| | | | | | |
|---|---|---|---|---|---|
| 3,106,627 | A | * | 10/1963 | Lisnay | 218/149 |
| 4,393,287 | A | | 7/1983 | Nakano | |
| 4,511,772 | A | * | 4/1985 | Link et al. | 218/149 |
| 4,737,606 | A | * | 4/1988 | Winter | 218/151 |
| 5,153,545 | A | * | 10/1992 | Ferullo et al. | 335/201 |
| 2013/0015044 | A1 | * | 1/2013 | Lee et al. | 200/175 |

FOREIGN PATENT DOCUMENTS

| | | |
|---|---|---|
| FR | 1 060 926 | 4/1954 |
| FR | 2 465 308 | 3/1981 |
| FR | 2 471 661 | 6/1981 |
| JP | 63-91141 | 6/1988 |
| JP | 7-130272 | 5/1995 |

* cited by examiner

ARC EXTINGUISHING CHAMBER FOR AN ELECTRIC PROTECTION APPARATUS AND ELECTRIC PROTECTION APPARATUS COMPRISING SAME

BACKGROUND OF THE INVENTION

The present invention relates to an arc extinguishing chamber for an electric protection apparatus comprising an arc formation chamber containing a stationary contact and a movable contact which, when they separate, form an arc between them, said arc formation chamber communicating with the inlet of a second chamber, called arc extinguishing chamber.

STATE OF THE PRIOR ART

In known circuit breakers, in particular miniature current limiting circuit breakers, it has been observed that after switching of the arc and displacement of the latter to the breaking chamber in the direction of the extinguishing chamber, re-breakdown phenomena occur which more or less greatly degrade the quality of breaking.

Certain of these apparatuses, such as those described for example in the documents EP 1 017 072 or FR 2 471 661, comprise elements forming insulating grids located downstream from the arc extinguishing chamber, the openings of which are designed to allow passage of the gases generated when arc breaking is performed. The role of this plastic grid placed against the arc extinguishing chamber and downstream from the latter is to remove and control the outgoing gas flow so as to prevent re-breakdown between fins at the rear of the extinguishing chamber, and prevent the arc from establishing downstream.

This insulating grid placed downstream from the extinguishing chamber is formed either by an additional non-meltable part (thermosetting fibre or plastic), which increases the cost, either by addition of a suitable shape moulded with the thermoplastic case, which melts when the apparatus is subjected to several successive short-circuits, which further disturbs removal of the breaking gases.

It is known that these re-breakdown phenomena are due to a poor insertion of the arc in the extinguishing chamber, this defective insertion being due to a badly controlled flow of the gases.

Indeed, in most circuit breakers, certain fins are reached first by the gases resulting in a flow of the gases on the fins concerned.

The gases in fact take the most direct path and therefore go more easily to the side of the chamber opposite the contacts than to the other side of the chamber, the point of departure of the gases being the contact area.

Depending on the arrangement of the removal channels downstream from the chamber, this first circulation can hamper or even prevent circulation of the hot gases between the other fins, thereby preventing balanced insertion of the arc over the total height of the chamber. The arc therefore in fact inserts itself where the gases are the hottest, at the place where the gases are most conducting.

SUMMARY OF THE INVENTION

The present invention solves these problems and proposes an arc extinguishing chamber for an electric protection apparatus, and an electric protection apparatus comprising same, enabling the quality of breaking to be improved so as to improve the energy capacity of the apparatus.

For this purpose, the object of the present invention is to provide an arc extinguishing chamber of the above-mentioned kind, this extinguishing chamber being characterized in that it comprises a wall called balancing wall, substantially solid at least on its central part, said wall being located downstream from the arc extinguishing chamber and being formed and arranged with respect to the arc extinguishing chamber in such a way as to slow down the exhaust flow of the breaking gases on the side of the arc extinguishing chamber where the gases go first and enhancing flow of the exhaust gases on the opposite side, the exhaust gases being stopped by the central part of the wall and escaping via the edges of the wall.

By means of these features, the invention enables flow of the gases to be rebalanced, while limiting the flow in certain places where it was satisfactory to the profit of another place where it was insufficient.

According to a preferred particular embodiment of the invention, said arc extinguishing chamber comprising a stack of cooling elements extending in substantially parallel manner to one another, this chamber is characterized in that the above-mentioned wall is very close to the arc extinguishing chamber on the side where the exhaust gases go first and moves progressively away from said chamber as the distance from this side of the chamber increases, so as to be away from said chamber on the opposite side to the previous side of said arc extinguishing chamber.

This feature presents the additional advantage of eliminating the use of an insulating grid usually used to prevent the arc from establishing itself downside from the chamber, and usually located by necessity very close to the chamber.

This grid did in fact present the drawback of melting at the time breaking took place, which generated an obstruction preventing flow of the exhaust gases.

This balancing partition does in fact perform the same functions as the grid, apart from its first function which is to balance flow of the gases, does not need to be placed as close to the extinguishing chamber as the grid, presents very limited melting and vaporisation, which enables it not to disturb the flow of the gases, but suffices to keep the arc in the chamber. In addition, this partition also presents the advantage of being more robust than a grid and of being easier to mould.

According to a particular feature of the invention, the above-mentioned arc extinguishing chamber comprises a reduced number of cooling elements enabling the unit formed by the set of these cooling elements to be inclined with respect to the base of the apparatus, and the above-mentioned wall extends in substantially parallel manner to the base of the apparatus.

According to another feature, the above-mentioned wall extends forming an angle comprised between 3 and 15° with the direction of alignment of the above-mentioned cooling elements.

According to another embodiment of the invention, said balancing wall presents a variable width, this width being maximum on the side of the arc extinguishing chamber where the gases pass first, and being progressively reduced as the other side of said chamber is approached.

According to a particular feature of the invention, the above-mentioned wall is moulded with the case or the cover of the apparatus.

According to another embodiment of the invention, said arc extinguishing chamber comprising means for securing the cooling elements with respect to one another, the above-mentioned wall forms an integral part of these means for securing the cooling elements.

Advantageously, this above-mentioned balancing wall forms an integral part of the back wall of the above-mentioned means for securing the cooling elements, said back wall comprising slits, around said balancing wall, extending in substantially parallel manner to the cooling elements and having a length which varies from one end of the wall to the other.

Thus, according to this embodiment, a single part performs three functions, i.e. securing of the fins, balancing of the gas flow, and limiting of the re-breakdown risks.

It is a further object of the present invention to provide an electric protection apparatus comprising at least one polar unit fitted in a case, said polar unit comprising the above-mentioned features taken either alone or in combination.

According to a particular feature, this apparatus is a low-voltage electric circuit breaker.

BRIEF DESCRIPTION OF THE DRAWINGS

But other advantages and features of the invention will become more clearly apparent from the following detailed description which refers to the appended figures given for example purposes only, and in which.

DETAILED DESCRIPTION OF PARTICULAR EMBODIMENTS

Figure 1:
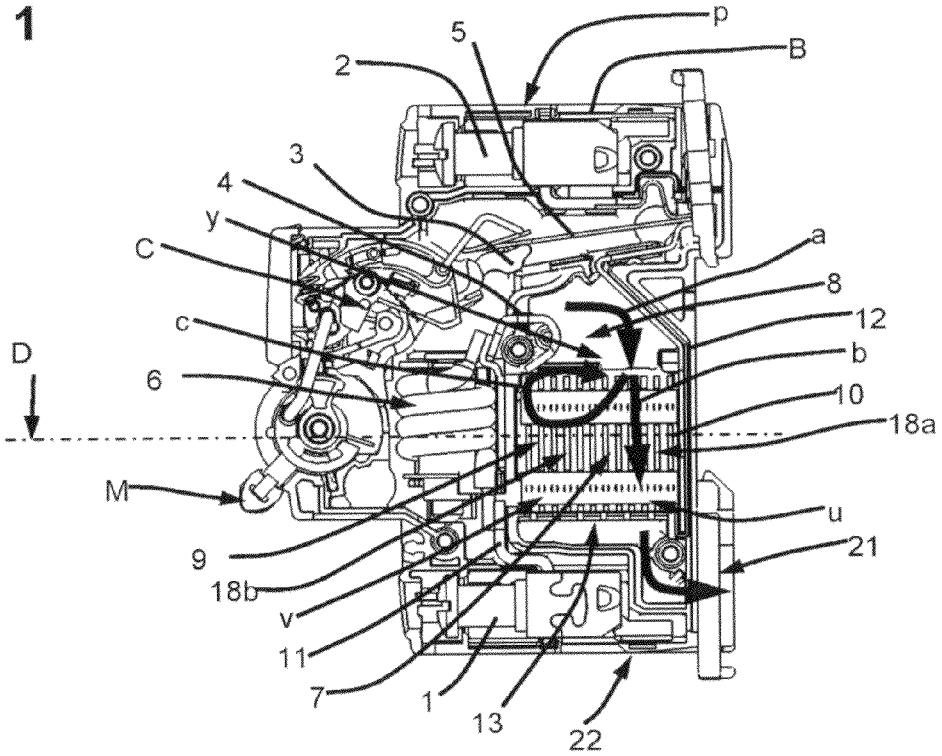
FIG. 1 is a plane view of a circuit breaker according to the prior art, illustrating the innards of the apparatus.

In FIGS. 1, 2, 4, 6, 9, 10, a pole p of a miniature circuit breaker can be seen comprising an insulating case B having an operating handle M on its front panel and connection terminals 1,2 on its two narrow side panels. A movable contact 3 and a stationary contact 4 are housed inside the case, in a manner known as such.

The movable contact 3 is controlled by an operating mechanism C connecting the above-mentioned handle M to the movable contact for closing or opening of the contacts.

A thermal trip release 5 and an electromagnetic trip release 6, designed to perform automatic opening of the contacts 3,4 in case of an overload or a short-circuit, are also housed in this case.

The bottom part of the case B contains a breaking chamber 7 formed by a first chamber called arc formation chamber 8 communicating with the inlet of a second chamber called arc extinguishing chamber, the latter comprising fins 10.

The movable contact 3 extends substantially perpendicularly to the plane in which the plates extend so as to draw an arc between the contacts when separation of the latter takes place, the initial direction of which is substantially parallel to the plates.

The above-mentioned breaking chamber 7 is laterally delineated by arcing horns 11,12 respectively connected electrically to the above-mentioned two terminals. These arcing horns are arranged so as to pick up the arc drawn between the contacts when separation of the latter takes place.

Such a circuit breaker being well known to specialists, it will not be useful to describe its arrangement or operation in greater detail.

In FIG. 1, the arc extinguishing chamber 9 of the circuit breaker simply comprises, in its downstream part, a grid 13 made from plastic, advantageously moulded with the case or the cover of the apparatus. The function of this grid is to prevent the arc from reforming behind the fins downstream from the arc extinguishing chamber.

Figure 2:
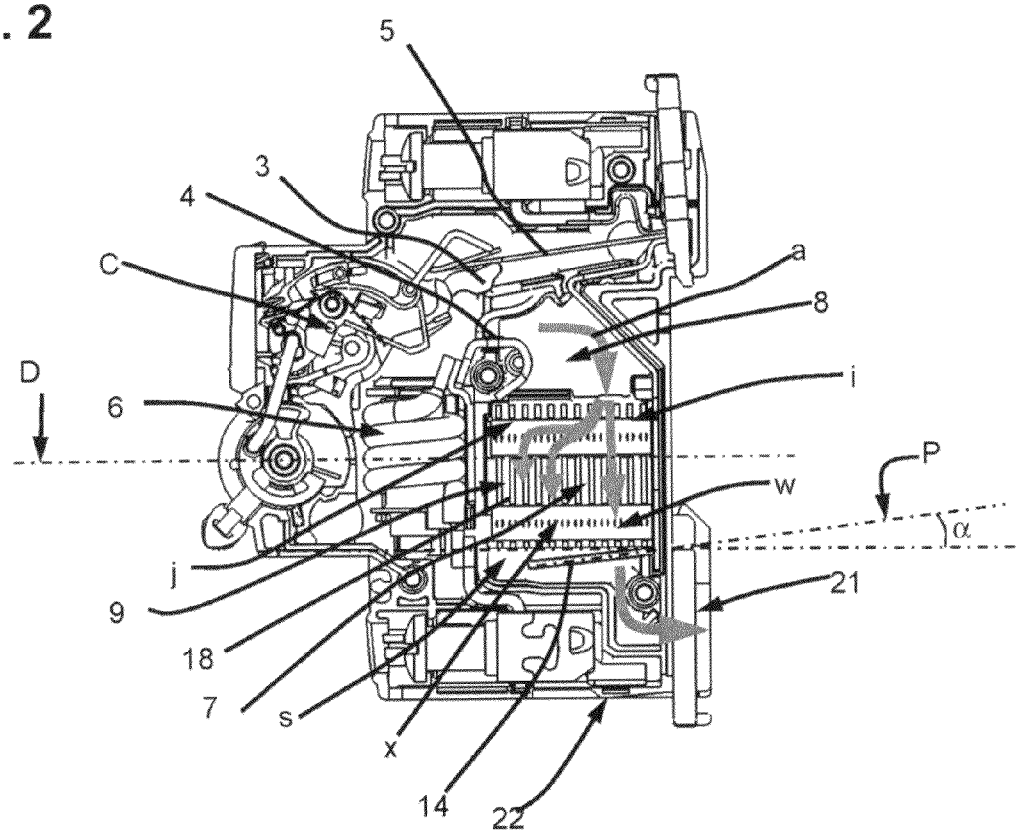
FIG. 2 is a plane view, similar to FIG. 1, of a circuit breaker according to a particular embodiment of the invention.

In FIG. 2, according to a preferred embodiment of the invention, the arc extinguishing chamber 9 comprises a wall called balancing wall 14 extending in an inclined plane P with respect to the direction of alignment D of the separators 10, or the base plane 22 of the apparatus, with an angle $\alpha$ preferably of about 5°, in such a way that the balancing wall 14 is closer to the separators 10 on the side i where the gases first enter the arc extinguishing chamber 9 (right-hand side of the figure), and farther away on the other side j (left-hand side of the figure). Advantageously, this wall extends substantially over the whole width of the breaking chamber, this width being defined parallel to the base of the apparatus and perpendicularly to the fixing plane of the apparatus. This wall is very close to the set of fins, i.e. almost in contact with the latter.

It can be noted that the value of the above-mentioned angle will advantageously be comprised between 3 and 15°, and preferably 5°.

It can be noted that the side where the wall 14 is closest corresponds to the side opposite the stationary contact 4 and movable contact 3.

It can thus be seen in FIG. 2 that the wall 14 is closer to the arc extinguishing chamber 9 on the side where the arcing horn 12 is situated on the fixing surface side of the apparatus, and moves progressively away from this chamber when moving in the direction of the other side.

Advantageously, this wall 14 is moulded with the case or the cover of the apparatus.

Figure 4:
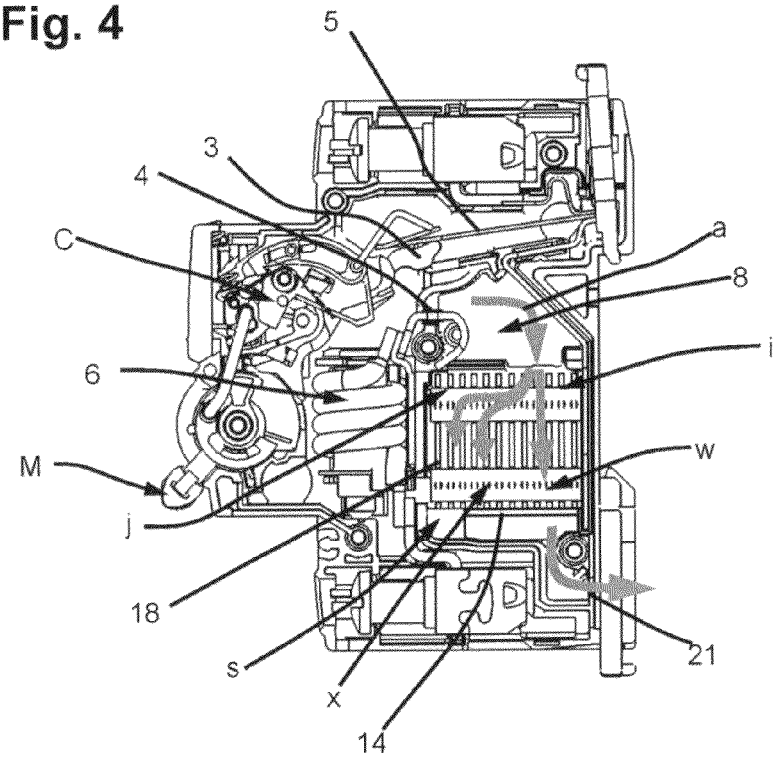
FIG. 4 is a plane view, similar to FIGS. 1 and 2, of a circuit breaker according to a second embodiment of the invention.
Figure 5:
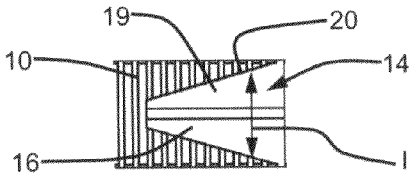
FIG. 5 is a bottom view of a balancing partition equipping the arc extinguishing chamber of a circuit breaker according to FIG. 4.

As illustrated in FIG. 4, according to another embodiment of the invention, modulation of the exhaust cross-section is this time obtained by a partition 14 extending in substantially parallel manner to the rear surface of the set of fins and presenting a width I that is increasingly smaller, as illustrated in FIG. 5, so as to create an increasingly large exhaust cross-section from one side of the wall 14 to the other, the exhaust cross-section s being the smallest on the side where the gases first enter the arc extinguishing chamber 9. Advantageously, this wall presents a trapezoid shape.

Figure 6:
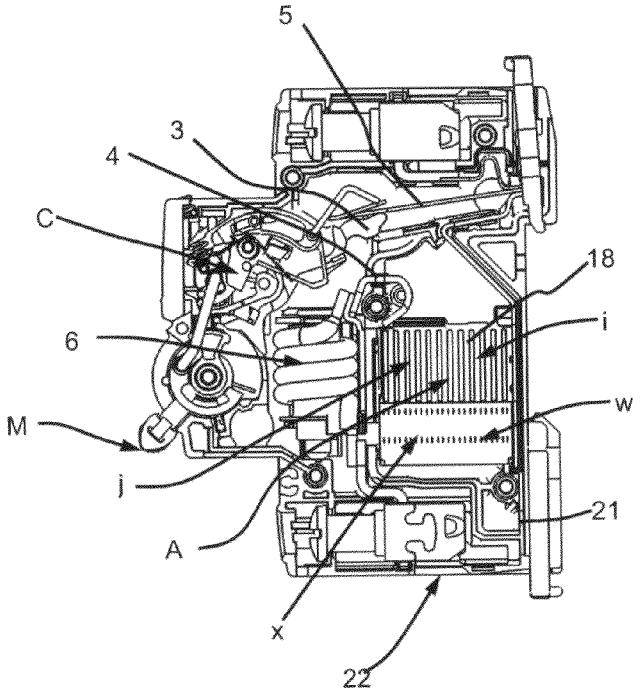
FIG. 6 is a plane view, similar to FIGS. 1, 2 and 4, of a circuit breaker according to another embodiment of the invention.

In FIG. 6, according to another embodiment of the invention, a part already present in the apparatus is used, which part, called grey fibre 15, surrounds the set of separators 10 on the exhaust side and is designed to secure these separators so as to form a set of fins A constituting the arc extinguishing chamber 9. This part is an independent part from the partitions of the case or of the cover and therefore presents a better heat resistance than that of the plastic material used for the partitions of the apparatus. It is therefore not necessary to locate it at a distance, as is the case when an inclined wall moulded with the walls of the case is used.

According to this particular embodiment, modulation of the size of the exhaust cross-section s is performed by making openings 17 all of the same width in the above-mentioned part, on each side of a solid part 16, the length of the openings however increasing in the direction of the end of the chamber situated on the side j where the stationary contact 4 is located, so as to create more exhaust flow on this side and less on the opposite side i.

Figure 9:
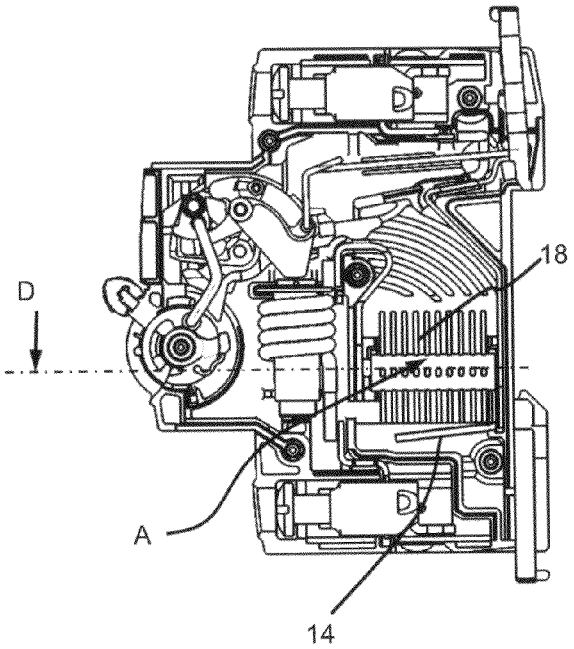
Figure 10:
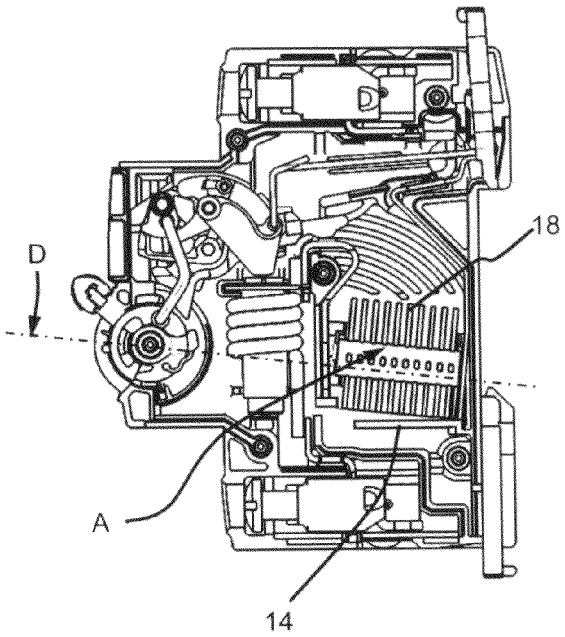

According to the embodiments illustrated in FIGS. 9 and 10, the size of the arc extinguishing chamber 9 is reduced by the fact that the number of cooling fins 18 is 10 compared with the number of fins, i.e. 12, used in the previously described embodiments.

According to the embodiment of FIG. 9, the direction of alignment D of the fins extends substantially parallel to the base 22 of the apparatus, and it is the wall 14 that is inclined with respect to this direction of alignment D and to this base 22.

According to the embodiment of FIG. 10, it is the set of fins A that is inclined with respect to the base 22 of the apparatus, which is made possible by the fact that the number of fins is reduced. The balancing wall 14 extends in this case in a plane parallel to the base 22 of the apparatus, and is inclined with respect to the direction of alignment D of the fins 18 of the chamber, preferably by an angle of about 5°.

In FIGS. 1, 2, 4, 6, 9 and 10, flow of the gases generated when breaking takes place is represented by arrows situated inside the arc extinguishing chamber.

It can be noted that the invention, in all the described embodiments, enables the insulating grid provided in the prior art to be eliminated.

It can also be noted that when the balancing partition is of uniform width, the latter must necessarily be inclined by an angle $\alpha$ comprised between 3 and 15° with respect to the direction of alignment or the bottom surface of the cooling elements. In the embodiment of the invention wherein the balancing partition is of trapezoid shape, this partition will preferably be parallel to the rear surface of the cooling elements. In this case, the shape of the partition or of the angle of incline will be able to be adjusted, the latter being able to vary between 0 and 15°.

Operation of an apparatus according to the prior art, and according to the different embodiments of the invention, will be described hereafter with reference to the figures.

In FIG. 1, it can be seen that the gas flow due to formation of the arc separates into a part b passing through the arc extinguishing chamber 9 on one side i of this chamber, whereas another part c of the gases is discharged to a turbulence area y, the insulating grid 13 placed downstream from the arc extinguishing chamber 9 thus presenting a direct exhaust area u and a discharge area v.

Thus, as explained previously, one i of the sides i,j of the arc extinguishing chamber 9 is reached first by the gases, inducing flow of the gases on the fins 18*a* situated on this side. This first flow hinders or even prevents flow of the gases between the other fins 18*b*. This leads to a discharge of the gases upstream from the arc extinguishing chamber 9, thereby preventing balanced insertion of the arc over the whole height of the arc extinguishing chamber 9.

In FIG. 2, the exhaust gases are stopped by the central part 19 of the inclined wall 14 and escape via the outer edges 20 of the partition 14 in the direction of the exhaust outlet 21 provided in the case B.

The presence of the inclined wall 14 creates a slowed-down flow area w, downstream from the arc extinguishing chamber 9, on the side where the partition 14 is closest to the arc extinguishing chamber 9, and a facilitated flow area x on the side where the partition 14 is farthest from the arc extinguishing chamber 9.

Rebalancing of the flow of gases through the arc extinguishing chamber 9 is thus obtained, limiting the flow between the first fins 18*a* to the profit of the other fins 18*b*.

Furthermore, this preferred embodiment of the invention enables the plastic grid located very close to the chamber to be eliminated to the profit of this partition that is farther away, the limited melting and vaporisation of which does not disturb the flow of the gases but is sufficient to maintain the arc in the chamber.

Figure 3:
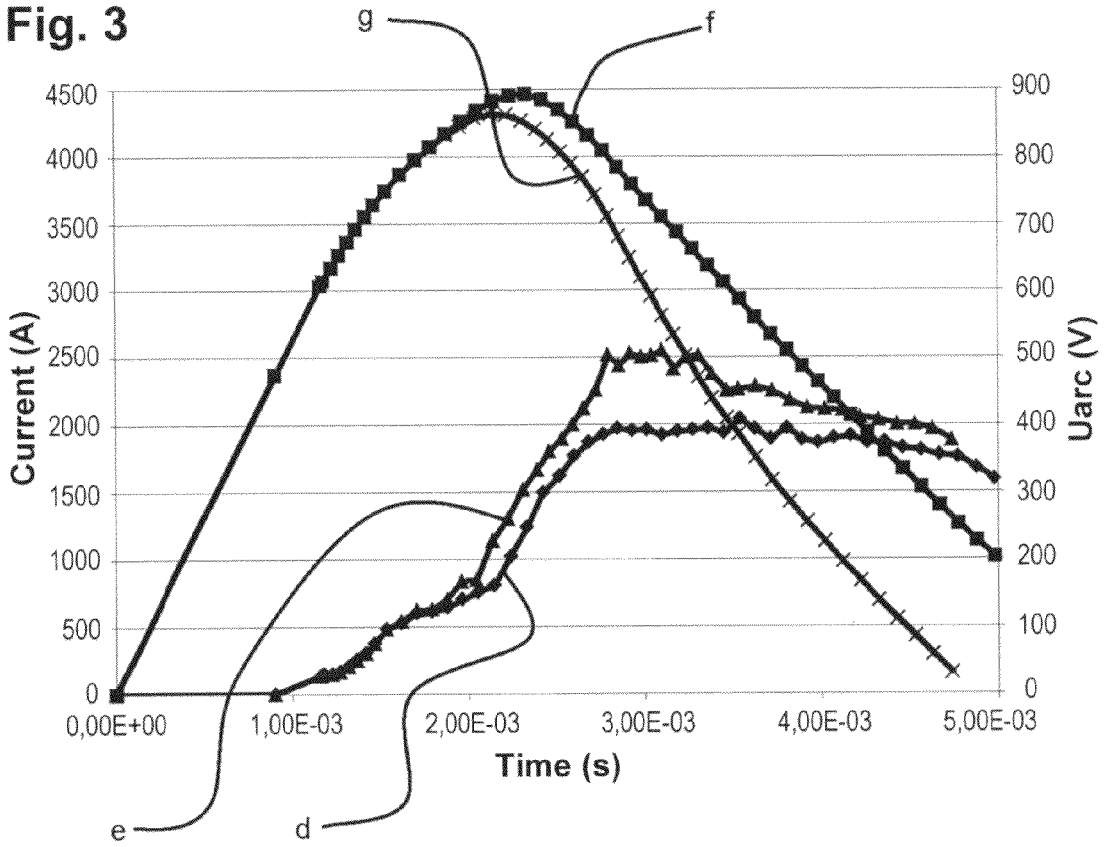
FIG. 3 is a graphic representation illustrating the arcing voltage and the current flowing in the apparatus versus time, for an apparatus according to the prior art and for an apparatus according to a preferred embodiment of the invention.

Mastery of the gas flow downstream from the chamber is thus obtained by means of the invention, which enables the mean arcing voltage to be increased, as illustrated in FIG. 3 which represents the arcing voltage and the current flowing through the circuit breaker versus time for a product called reference product corresponding to the prior art and for an apparatus according to the preferred embodiment of the invention. Curve plots d and e thus represent the arcing voltages respectively for the reference product and for an apparatus according to the invention, whereas plots f, g represent the currents flowing through the circuit breaker respectively for these same apparatuses. The existence of a pressure reduction of about 14% in the case of an apparatus according to the invention can also be noted. The current represented on the left-hand scale is in amps, whereas the voltage represented on the right-hand scale is in volts. The time on the x-axis is in seconds.

It can thus be seen on these curves that, by means of the invention, the arcing voltage increases more rapidly and reaches a higher value thereby enabling better limiting (i.e. the current which increases less and a current zero obtained more rapidly). The pass-through energy ($I^2dt$) is consequently reduced from the energy point of view. A gain of 20% is thereby obtained:

$$(I^2dt\text{ref}-I^2dt\text{invention})/I^2dt\text{ref})=20\%.$$

According to the embodiments illustrated in FIGS. 4 and 5, the partition 14 of decreasing width enables rebalancing of the gas flow through the arc extinguishing chamber to be obtained, in the same way as for the previous embodiment.

Figure 7:
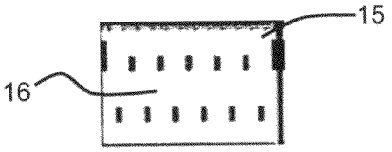
FIGS. 7 and 8 are bottom views of an element called grey fibre designed to respectively equip a circuit breaker according to the prior art and a circuit breaker according to FIG. 6, and FIGS. 9 and 10 are similar views to FIGS. 1, 2, 4 and 6 of a circuit breaker respectively according to two other embodiments of the invention.
Figure 8:
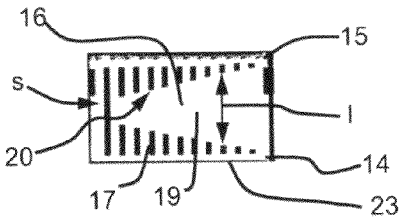

According to the embodiment illustrated in FIGS. 6, 7 and 8, the part called "grey fibre 15" known to secure the fins 18 in order to form the arc extinguishing chamber 9 is used, this part surrounding the chamber on the exhaust side in order on the one hand to perform the function associated with the insulating grid 13 and on the other hand to perform rebalancing of the gas flow.

For this purpose it can be seen in this fibre 15 comprises a back wall 23 comprising a solid part 16 presenting a decreasing width I as in the embodiment illustrated in FIG. 4, this solid part fulfilling the same function with the same results as the partition according to the second embodiment illustrated in FIG. 5, the breaking gases being slowed down by this solid part 16 and escaping via the edges 20 of said partition through the openings 17 provided all around this solid part 16.

As the temperature resistance of the fibre is better than that of the plastic material used to produce the partitions of the apparatus and therefore the insulating grid, this fibre does not have to be located away from the chamber.

Operation of the apparatuses according to the two embodiments illustrated in FIGS. 9 and 10 will not be described, as it corresponds to that of the apparatus according to the embodiment illustrated in FIG. 2.

An arc extinguishing chamber has therefore been achieved by means of the invention that is of simple design enabling re-breakdowns due to poor insertion of the arc in the chamber to be reduced, this poor insertion itself being due to a gas flow that is not properly controlled. Thus, by means of the elements provided by the invention downstream from the arc extinguishing chamber, the gas flow upstream from the chamber is increased enabling complete insertion of the arc. This results in a gain in ruggedness of the apparatus, without any additional cost.

Breaking is thereby improved by mastering the arcing voltage.

Indeed, increasing the arcing voltage enables the energy to be absorbed by the apparatus to be reduced and the energy capacity of the apparatuses to be improved, thereby limiting any damage due to a short-circuit.

The invention also enables the insulating grid that is usually used to be eliminated, which leads to a rationalisation in the design of the apparatuses in which this extinguishing chamber is designed to be used.

The invention is naturally not limited to the described and illustrated embodiments which have been given for example purposes only.

On the contrary, the invention extends to encompass all the technical equivalents of the described means as well as combinations thereof if the latter are achieved according to the spirit of the invention.

The invention claimed is:

1. An arc extinguishing chamber of an electric protection apparatus comprising an arc formation chamber containing a stationary contact and a movable contact which, when separated, form an arc therebetween, said arc formation chamber communicating with the inlet of an arc extinguishing chamber; and a balancing wall substantially solid at least at a central part, said balancing wall being located downstream from the arc extinguishing chamber and being formed and arranged with respect to the arc extinguishing chamber in such a way as to slow down the exhaust flow of exhaust gases on a side of the arc extinguishing chamber situated opposite the stationary contact, the exhaust gases being stopped by the central part of the balancing wall and escaping via the edges of the wall, wherein said central part of the balancing wall is a solid central part having a variable width being maximum on the side of the arc extinguishing chamber where the gases flow first, and being progressively reduced as an opposite side of said chamber is approached.

2. The arc extinguishing chamber according to claim 1, said arc extinguishing chamber comprising a stack of cooling elements extending in substantially parallel manner to one another, wherein the balancing wall is adjacent to the arc extinguishing chamber on the side and moves progressively away from said arc extinguishing chamber as a distance from the side of the chamber increases.

3. The arc extinguishing chamber according to claim 2, wherein the arc extinguishing chamber comprises cooling elements that are inclined with respect to a base of the electric protection apparatus, and the balancing wall extends in substantially parallel manner to the base of the electric protection apparatus.

4. The arc extinguishing chamber according to claim 2, wherein the balancing wall extends forming an angle comprised between 3 and 15° with the direction of alignment of the cooling elements.

5. The arc extinguishing chamber according to claim 1, wherein the balancing wall is moulded with the case or the cover of the electric protection apparatus.

6. The arc extinguishing chamber according to claim 2, wherein said arc extinguishing chamber comprises means for securing the cooling elements with respect to one another, the balancing wall forming an integral part of the means for securing the cooling elements.

7. The arc extinguishing chamber according to claim 6, wherein the balancing wall forms an integral part of a back wall of the means for securing the cooling elements, said back wall comprising slits, around said balancing wall, extending in substantially parallel manner to the cooling elements and having a length which varies from one end of the wall to the other.

8. An electric protection apparatus comprising at least one polar unit fitted in a case, said polar unit comprising an arc extinguishing chamber including an arc formation chamber containing a stationary contact and a movable contact which, when separated, form an arc therebetween, said arc formation chamber communicating with the inlet of the arc extinguishing chamber, and a balancing wall substantially solid at least at a central part, said balancing wall being located downstream from the arc extinguishing chamber and being formed and arranged with respect to the arc extinguishing chamber in such a way as to slow down the exhaust flow of exhaust gases on a side of the arc extinguishing chamber situated opposite the stationary contact, the exhaust gases being stopped by the central part of the balancing wall and escaping via the edges of the wall, wherein said central part of the balancing wall is a solid central part having a variable width being maximum on the side of the arc extinguishing chamber where the gases flow first, and being progressively reduced as an opposite side of said chamber is approached.

9. A low-voltage circuit breaker comprising at least one polar unit fitted in a case, said polar unit comprising a breaking chamber including an arc formation chamber containing a stationary contact and a movable contact which, when separated, form an arc therebetween, said arc formation chamber communicating with the inlet of an arc extinguishing chamber, and a balancing wall substantially solid at least at a central part, said balancing wall being located downstream from the arc extinguishing chamber and being formed and arranged with respect to the arc extinguishing chamber in such a way as to slow down the exhaust flow of exhaust gases on a side of the arc extinguishing chamber situated opposite the stationary contact, the exhaust gases being stopped by the central part of the balancing wall and escaping via the edges of the wall, wherein said central part of the balancing wall is a solid central part having a variable width being maximum on the side of the arc extinguishing chamber where the gases flow first, and being progressively reduced as an opposite side of said chamber is approached.

* * * * *